US005438813A

United States Patent [19]

Wade

[11] Patent Number: 5,438,813

[45] Date of Patent: Aug. 8, 1995

[54] METHOD FOR INSULATING WALLS OF FURNACE

[75] Inventor: James A. Wade, Salina, Okla.

[73] Assignee: A. P. Green Industries, Inc., Mexico, Mo.

[21] Appl. No.: 110,163

[22] Filed: Aug. 19, 1993

Related U.S. Application Data

[63] Continuation-in-part of Ser. No. 985,005, Dec. 2, 1992, abandoned.

[51] Int. Cl.[6] ..... E04B 1/38; E04G 21/00

[52] U.S. Cl. ..... 52/747.13; 52/506.02; 52/506.05

[58] Field of Search ..... 52/384, 404, 511, 512, 52/747, 506.02, 506.05; 411/2, 8, 32, 42, 44, 45, 57, 66, 69, 71, 73, 508–510, 913, 969; 110/336; 81/441, 467, 471, 900

[56] References Cited

U.S. PATENT DOCUMENTS

| | | | |
|---|---|---|---|
| 3,331,267 | 7/1967 | Tietge | 81/471 |
| 3,706,870 | 12/1972 | Sauder et al. | 219/98 |
| 3,865,007 | 2/1975 | Stanback | 411/2 |
| 4,068,555 | 1/1978 | Volkman | 411/2 |
| 4,215,600 | 8/1980 | Kesselman | 81/471 |
| 4,574,995 | 3/1986 | Sauder et al. | 110/336 |
| 4,584,814 | 4/1986 | Hounsel et al. | 52/747 |
| 4,848,055 | 7/1989 | Wade | 52/506 |
| 5,010,706 | 4/1991 | Sauder | 52/506.02 |
| 5,176,050 | 1/1993 | Sauer et al. | 81/467 X |
| 5,299,474 | 4/1994 | Hohmann et al. | 81/467 X |

OTHER PUBLICATIONS

Weld-Loc/Anchor-Loc Publication, 1990, pp. 1–3.

*Primary Examiner*—Peter M. Cuomo
*Assistant Examiner*—Suzanne L. Dino
*Attorney, Agent, or Firm*—Senniger, Powers, Leavitt & Roedel

[57] ABSTRACT

An improved ceramic fiber module for installation a high temperature furnace. The module is made from ceramic fiber mats having hot and cold faces. The module includes a tine which impales each of the mats in a plane generally parallel to the hot and cold faces. The tine receives a threaded stud through its central opening. The module is welded to the interior wall of the furnace. The tine is thereafter forced downwardly toward the wall of the furnace to pull the module against the interior wall of the furnace thereby enveloping the stud within the module and compressing the mats of the module against the interior wall.

8 Claims, 4 Drawing Sheets

METHOD FOR INSULATING WALLS OF FURNACE

This application is a continuation-in-part of application Ser. No. 07/985,005, filed Dec. 2, 1992 and now abandoned.

BRIEF SUMMARY OF THE INVENTION

This invention relates generally to high temperature insulation modules, and more specifically to a method of installing insulation modules.

Ceramic fiber modules are used for insulating heat treating furnaces, ceramic kilns, brick kilns and other kinds of furnaces. Blankets of alumina-silica fibers are cut into strips or folded and edge-stacked to form blocks (i.e., modules) which can then be attached to the interior walls of the furnace. An example of a method for attachment of such insulation modules to walls of furnaces and the like is shown in my U.S. Pat. No. 4,848,055, the disclosure of which is incorporated herein by reference. In U.S. Pat. No. 4,848,055, studs are attached to the furnace walls before the modules are positioned on and secured to their respective studs. This system requires skilled laborers to install because the studs must be precisely positioned so that all of the modules will fit tightly together on the wall. U.S. Pat. No. 3,993,237 shows an insulation module having a stud held within the module prior to connection to the wall. The module may be mounted directly on the furnace walls by arc welding. However, there is no mechanism for compressing the module against the wall.

In general, modules must be placed in a relatively tight abutting relation with each other so that they form a heat seal to protect the walls from the extreme heat generated by the furnace. Also, it is important that the modules be attached to the walls of the furnace such that the ceramic fibers of the module are in contact with the furnace wall. The existing systems have modules which are mounted on the wall in such a way that air pockets or voids between the module and the wall may be formed. Since the modules are exposed to extreme heat, there is a tendency for the blocks to shrink, thereby causing the module to pull away from the wall. Air pockets between the module and the furnace walls can cause serious damage to the wall because the wall is exposed to the extreme heat of the furnace.

Among the several objects of the present invention may be noted the provision of an improved method for insulating the walls of a furnace in which physical contact between ceramic fiber modules and the interior walls of the furnace is maintained even under extreme heat and large temperature variations; the provision of such a method which does not require substantial preparation steps; the provision of such a method for insulating the walls of a furnace which can be carried out quickly by unskilled laborers; the provision of such a method which is readily used with existing arc welding machines; and the provision of such a method which is relatively inexpensive to manufacture.

Generally, an improved method for insulating a furnace wall comprises the steps of providing a ceramic fiber module having a hot face and a cold face in parallel relationship. The module comprises a plurality of ceramic fiber mats having major surfaces perpendicular to the hot and cold faces. An elongate tine, having a generally central opening therein, impales each of the mats in a plane generally parallel to the hot and cold faces. A stud, externally threaded along its entire length, has first and second opposite ends. The first end protrudes through and projects outwardly from the cold face of the module. The tine receives the stud through its central opening. The module is positioned with its cold face generally adjacent the interior wall of the furnace. The first end of the stud is then attached by welding to the interior wall. A fastener is threaded onto the second end of the threaded stud and tightened down against the tine. Next, a screw fastening tool is placed into the module over the fastener for engagement with the fastener. The screw fastening tool is adapted to tighten the fastener onto the stud. The fastener is tightened against the tine with the screw fastening tool thereby forcing the module against the interior wall of the furnace and compressing the ceramic fiber mats of the module. The tine pushes the module against the interior wall of the furnace as the fastener is tightened thereby enveloping the protruding part of said first end of the stud within the module and compressing the mats of the module against the interior wall. The tine is forced downwardly toward the wall of the furnace by the fastener until the fastener has been tightened to a sufficient torque wherein the screw fastening tool strips away from the fastener thereby ceasing the tightening of the fastener onto the stud.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
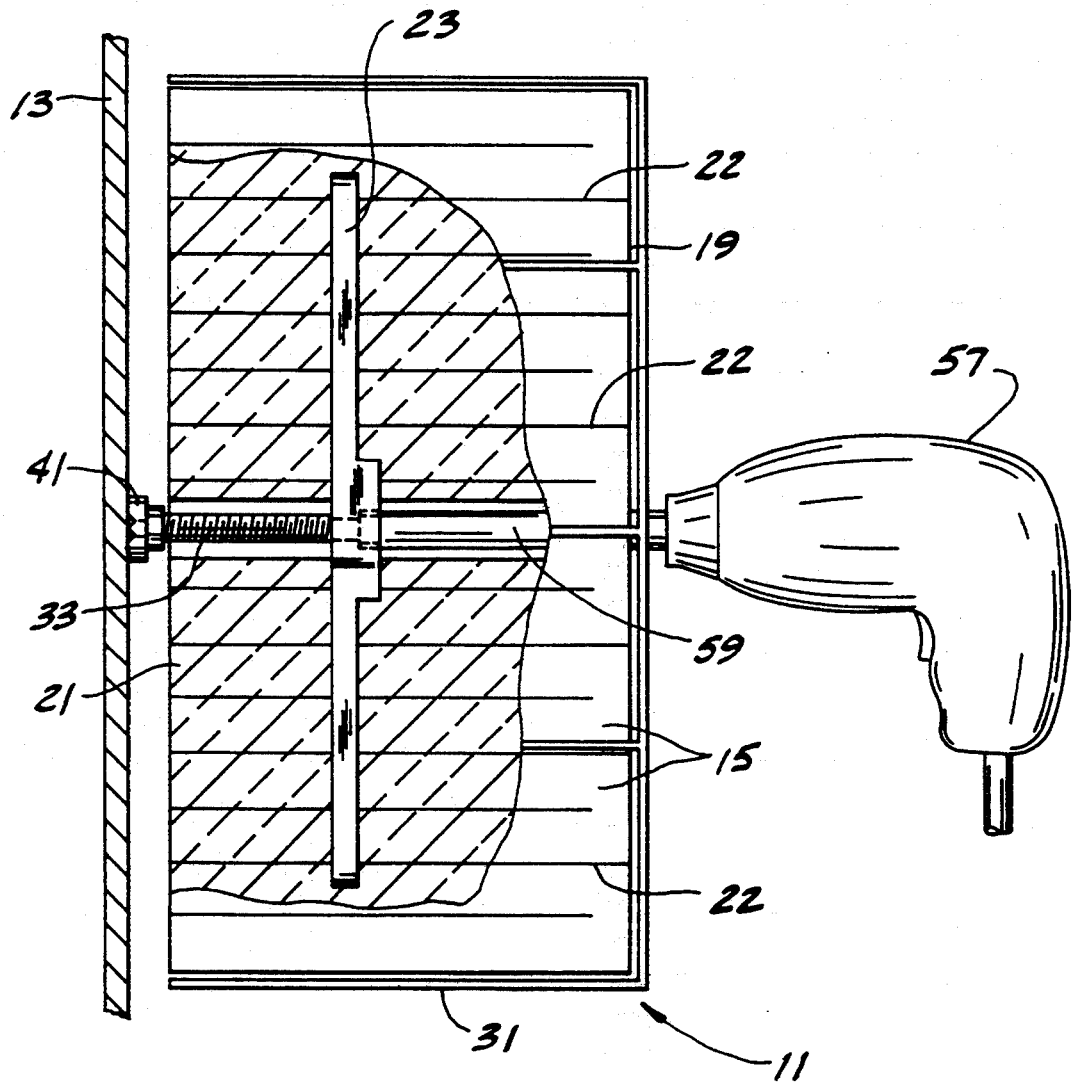
FIG. 1 is a side elevation, with portions removed, of a ceramic fiber module for use in insulating the walls of a furnace, the module being shown in a pre-mounted position.
Figure 2:
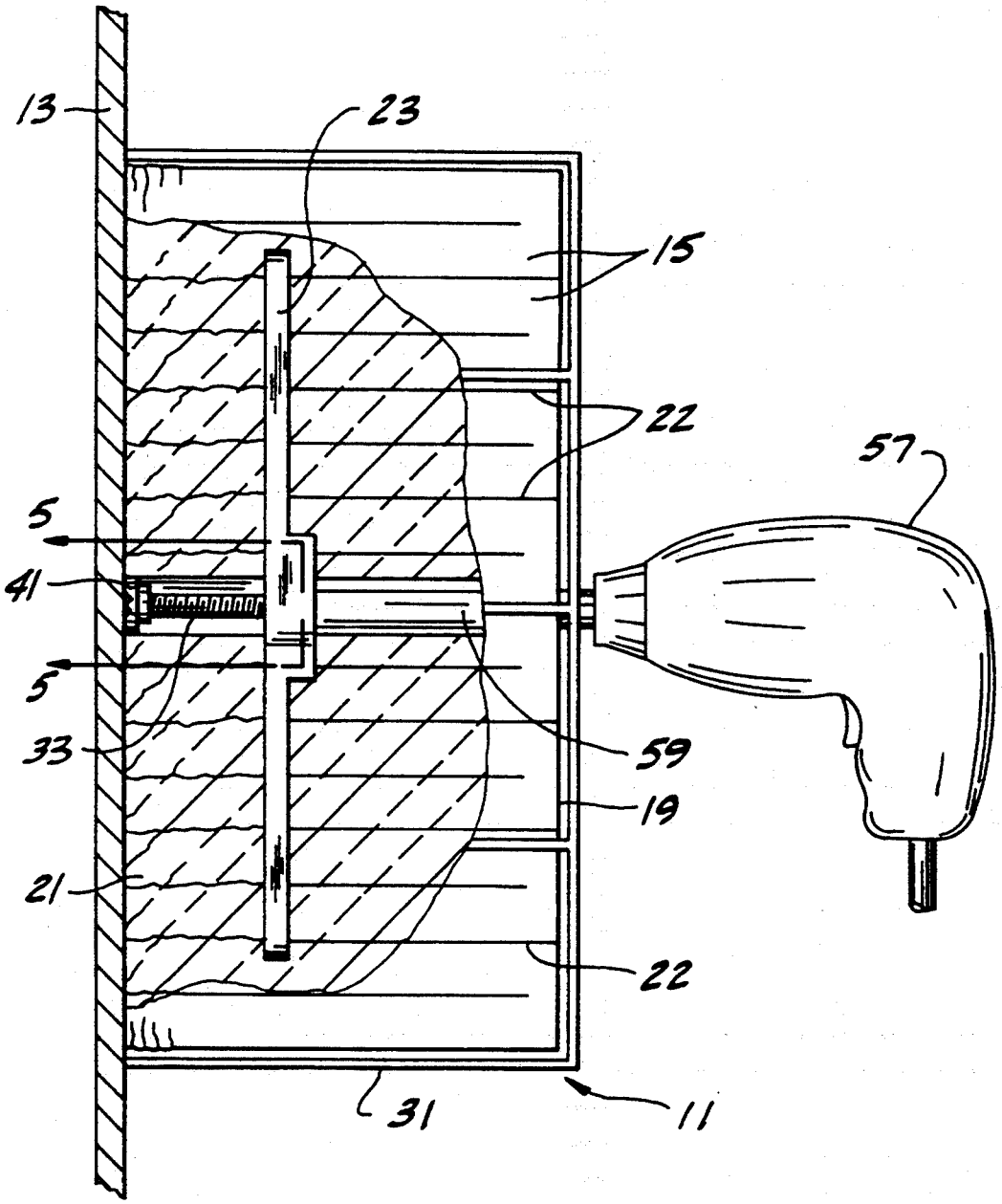
FIG. 2 is a side elevation similar to FIG. 1 showing the module mounted on a furnace wall.

Referring now to the drawings, there is shown a ceramic fiber module, indicated generally at 11, adapted for quick and easy installation on an interior wall 13 of a high temperature furnace. The module comprises a plurality of mats 15 (e.g., 8 mats as shown in FIGS. 1 and 2) folded in half and arranged together in the form of a block having a hot face 19 and a cold face 21 in parallel relationship. Major surfaces 22 of each mat 15 are perpendicular to the hot and cold faces 19, 21. The module is constructed with a substantially flat tine 23 having an elongated skewed diamond shape with a pointed tip 25 at each longitudinal end and a central opening 27 therein. The tine may be made of sheet metal which is formed by stamping from a blank.

The tine 23 impales each of the mats 15 in a plane parallel to the hot and cold faces 19, 21. The arrangement is such that the tine impales each mat for securely holding the module together. Each tip 25 of the tine 23 tapers to a point to easily penetrate the mats 15. The tine 23 widens towards its middle for strengthening the area around the opening 27. The mats 15 of the module may be cut down substantially to a size selected for use on the interior wall of the furnace without cutting the tine.

The construction and arrangement of the mats 15 and tines 23 is substantially the same as described in U.S. Pat. No. 4,848,055. Flanges 26 near the center of the tine of the present invention provide additional strength. The module is held together under compression by a net wrapper 31 which is cut after the module's installation to allow expansion so that adjacent modules are tightly packed together.

A stud 33, threaded externally along its entire length, is disposed between major surfaces 22 of adjacent mats 15 of the module 11 for mounting the module to the furnace wall 13. The stud 33 may be purchased as a stock item and comprises a first end 35, and a second end 37 opposite the first. The threads need not extend the complete length of the stud 33, but should extend from the second end 37 a substantial distance toward the first end 35. The first end 35 protrudes through and projects outwardly from the cold face 21 of the module as shown in FIG. 1, and the second end 37 is concealed within the module. An annular ceramic ferrule 41 is disposed generally around the first end 35 of the stud for containing a weld 45 when welding the module to the furnace wall as described hereinafter. The first end 35 of the stud has a tip 47 of reduced cross-sectional area to facilitate welding the stud to the furnace wall. Also, flux (not shown) may be added on the tip 47 to aid in welding the stud 33 to the furnace wall 13. The ferrule 41 is secured to the stud by a C-clip (not shown) or any other suitable fastener.

Figure 3:
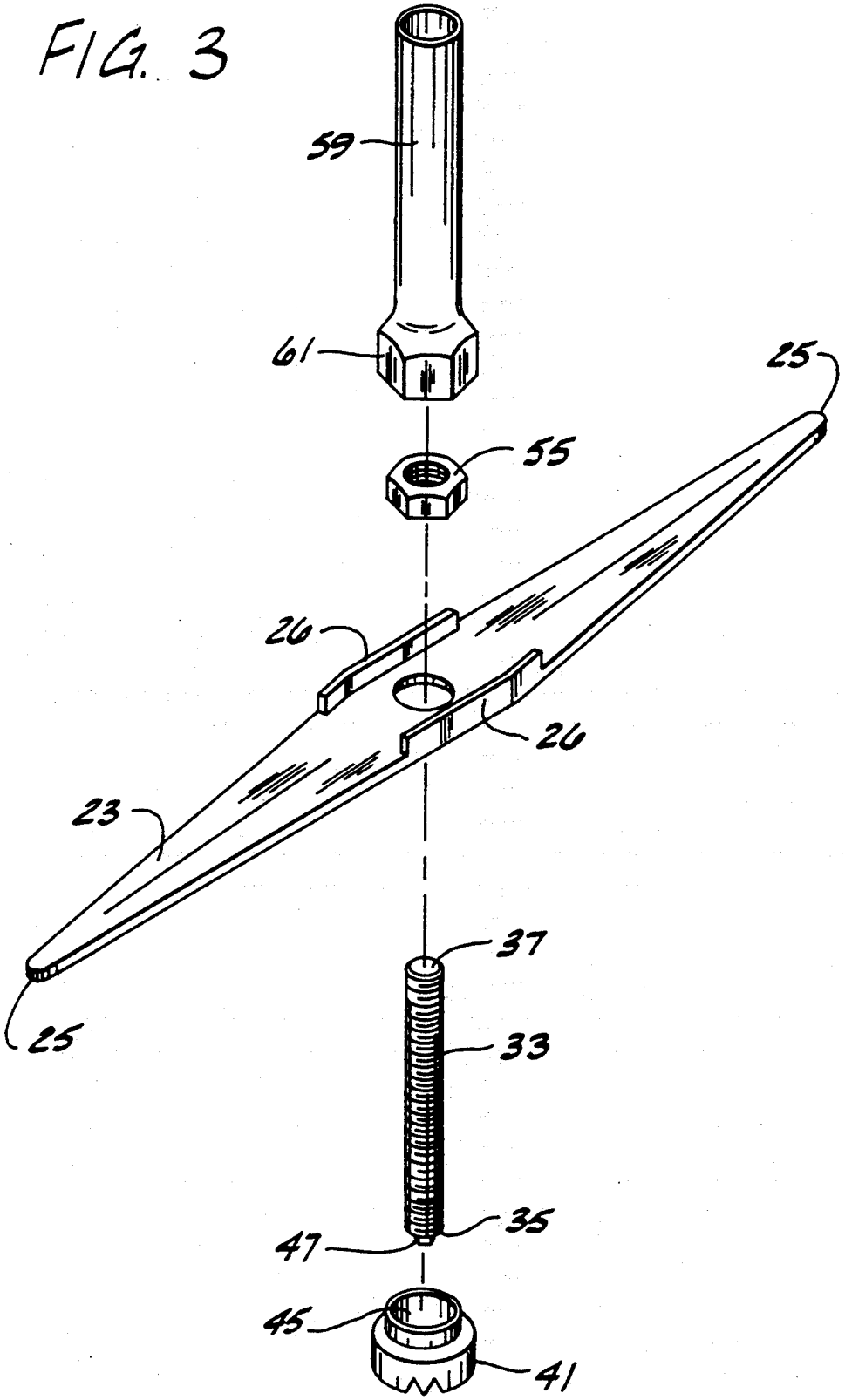
FIG. 3 is an exploded perspective of some of the components of the module and a weld/torque tube.

A fastener 55 (e.g., a standard hex nut as illustrated in FIG. 3 made from stainless steel) is threaded on the second end 37 of the stud and bears against the tine to hold the stud 33 in the mats. The fastener 55 also locates the stud 33 with respect to the module 11 so that the first end 35 of the stud protrudes from the mats 15 when the module is constructed. Holding the stud 33 so that its first end 35 protrudes from the mats 15 on the cold face 21 of the block formed by the mats is important for welding the modules to the interior wall 13 of the furnace, as described below. The stud 33 must be in position to make contact with the wall 13, and should preferably be spaced from the module 11 so that the mats 15 do not interfere with the distal end 43 of the stud during welding.

Referring to FIG. 1, modules 11 are attached to the interior wall 13 of the furnace by welding the stud 33 to the wall using an arc welding machine including in this embodiment a stud welding gun 57. The operation of stud welding guns is well known to those skilled in the art and will be described only generally herein. The stud welding gun 57 includes a weld/torque tube 59 (broadly, "fastening tool") having a socket 61 at one end adapted to capture the fastener 55 therein (FIG. 3). The weld/torque tube 59 serves initially as an extender reaching down from the hot face 19 between the mats 15 to the fastener 55 to bring the stud welding gun 57 into electrical contact with the stud 33. Upon activation of the stud welding gun 57, electric current is conducted from the gun through the fastener 55 to the stud 33 and arcs to the interior wall 13 so that the first end 35 of the stud is welded to the wall. The ferrule 41 contains the pool of molten material formed during the welding operation to a location around the stud. The stud 33 is now fixed to the wall 13, but still protrudes slightly from the mats 15 of the module so that the mats are generally spaced from or only loosely engaged with the wall.

Figure 5:
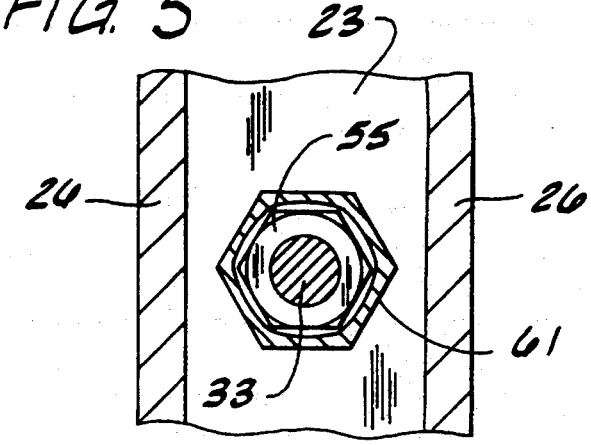
FIG. 5 is an enlarged fragmentary cross-sectional view taken along line 5—5 of FIG. 2 and showing the weld/torque tube as deformed.

The stud welding gun 57 is again activated, but this time acts as a drill rotating the weld/torque tube 59 about its longitudinal axis to move the fastener 55 toward the first end 35 of the stud 33 against the tine 23. The force applied by the fastener 55 to the tine 25 causes the tine to move toward the first end 35 of the stud 33 to a point where the portions of the mats between the tine and the wall 13 of the furnace are tightly compressed against the interior wall 13. As the tine 23 moves toward the end 35 of the stud 33, the mats 15 of the module are drawn toward the wall 13 so that the protruding first end 35 of the stud is enveloped within the mats. As the mats 15 are compressed against the interior wall, they provide an increasing reaction force in a direction opposite to the direction of motion of the tine 23 and fastener 55. The weld/torque tube 59 is made from a material softer than the material of the fastener 55 (e.g., aluminum) and is selected to strip away (i.e., as by yielding of the material) from the stainless steel nut fastener 55 when a predetermined reaction force is reached. More specifically, the socket 61 of the relatively ductile tube 59 deforms from its original hexagonal shape after a predetermined torque has been applied to the fastener 55 and releases the fastener (FIG. 5). In its final position, the tine 23 compresses the mats 15 tightly against the wall, providing a tight thermal seal. Thus, when the modules 11 contract during use of the furnace, they remain fully engaged and free of gaps with the wall.

Figure 4:
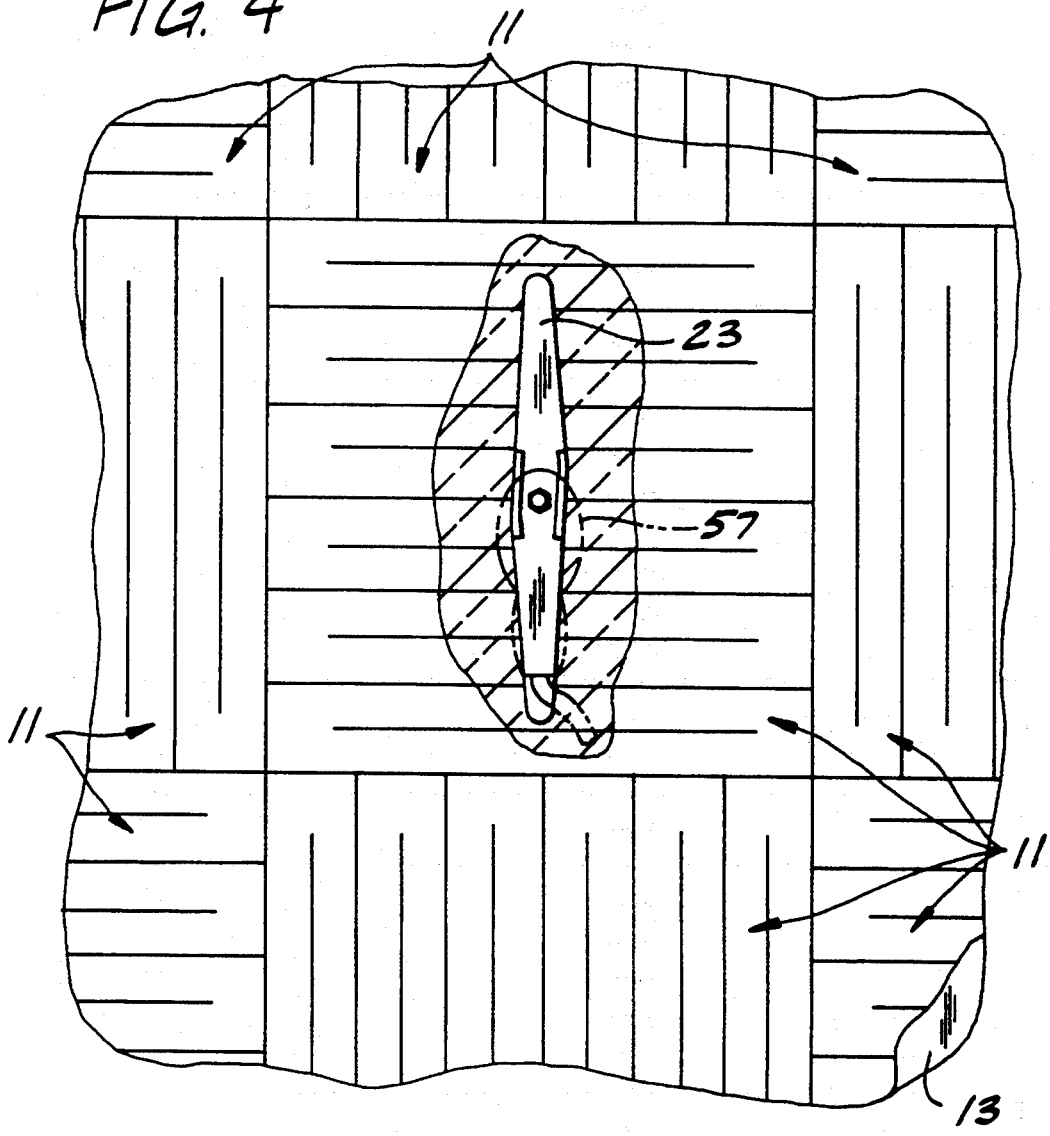
FIG. 4 is a front elevation of a plurality of modules installed on a furnace wall.

After installation of the module 11, the weld/torque tube 59 and welding gun 57 are removed from the module. Since the socket 61 of the weld/torque tube 59 is stripped, the tube is discarded. Additional modules may then be attached to the wall 13 following generally the same procedure. The modules may be trimmed down from their size shown in the drawings as needed to cover the wall 13. After all modules 11 are secured on the wall 13, the net wrappers 31 are cut so that the mats 15 expand into a tight engagement with the mats of adjacent modules. As shown in FIG. 4, the modules are preferably arranged in a parquet fashion (i.e., with the major surfaces of the mats of adjacent modules perpendicular to each other). It is to be understood that the welding operation and fastener tightening operations may be done with separate tools and still fall within the scope of the present invention.

The disclosed method has great flexibility because no pre-installation of the studs 33 on the wall 13 is required. Blocks of insulation may be attached to the wall 13 where needed to fill a space without substantial preplanning. Substantial planning is required where the studs must be installed prior to the blocks of insulation. Moreover, the method utilizes a simple standard threaded stud and a corresponding fastener which increases the speed of installation of the module since there are no component parts to manipulate.

In view of the above, it will be seen that the several objects of the invention are achieved and other advantageous results attained.

As various changes could be made in the above constructions without departing from the scope of the invention, it is intended that all matter contained in the above description as shown in the accompanying drawing shall be interpreted as illustrative and not in a limiting sense.

What is claimed is:

1. A method for insulating a furnace wall comprising the steps of:

providing a ceramic fiber module having a hot face and a cold face in parallel relationship, the module comprising a plurality of ceramic fiber mats having major surfaces perpendicular to the hot and cold faces, an elongate tine having a generally central opening therein, the tine impaling each of the mats in a plane generally parallel to the hot and cold faces, and a stud having first and second opposite ends, said first end protruding through and projecting outwardly from the cold face of the module, the tine receiving the stud through its central opening;

placing a fastener on the stud with the tine being located between the fastener and the first end of the stud, the fastener being engageable with the tine and being adapted for holding itself on the stud in a selected location along the length of the stud;

positioning the module with its cold face generally adjacent the interior wall of the furnace;

attaching as by welding the first end of the stud to the interior wall;

capturing the fastener with a fastening tool made of a yieldable material for movement of the fastener conjointly with the fastening tool; and compressing the mats against the interior wall of the furnace with a predetermined compression force by moving the fastener with the fastening tool toward the first end of the stud against the tine such that the tine is driven toward the first end of the stud, the tine pushing the module against the interior wall of the furnace as the fastener is moved thereby enveloping the protruding part of said first end of the stud within the module and compressing the mats of the module against the interior wall with the mats supplying an increasing reaction force resisting further movement of the tine and fastener toward the first end of the stud, the tine being driven toward said first end of the stud by the fastening tool until the reaction force is sufficiently large to cause the fastening tool material to yield and the fastening tool to release the fastener.

2. A method as set forth in claim 1 further comprising, prior to the step of capturing the fastener with the fastening tool, the step of selecting a fastening tool which is adapted to yield at a predetermined reaction force.

3. A method as set forth in claim 2 wherein the fastening tool is made from material softer than the nut.

4. A method as set forth in claim 3 wherein the fastening tool is made from aluminum.

5. A method as set forth in claim 1 wherein the step of attaching the first end of the stud to the wall comprises the steps of:

inserting a welding tool of an arc welding machine into the module and bringing it into electrical contact with the stud; and activating the arc welding machine to weld the first end of the stud to the interior wall.

6. A method as set forth in claim 1 comprising, prior to the step of positioning the module, the step of cutting the module down to a predetermined size selected for use on the interior wall of the furnace without cutting the tine.

7. A method as set forth in claim 1 further comprising, prior to the step of placing the fastener on the stud, the step of selecting a nut fastener, the fastening tool having a socket shaped to receive the nut fastener.

8. A method for insulating a furnace wall comprising the steps of:

providing a ceramic fiber module having a hot face and a cold face in parallel relationship, the module comprising a plurality of ceramic fiber mats having major surfaces perpendicular to the hot and cold faces, an elongate tine having a generally central opening therein, the tine impaling each of the mats in a plane generally parallel to the hot and cold faces, and a stud having first and second opposite ends, said first end protruding through and projecting outwardly from the cold face of the module, the tine receiving the stud through its central opening;

placing a fastener on the stud with the tine being located between the fastener and the first end of the stud, the fastener being engageable with the tine and being adapted for holding itself on the stud in a selected location along the length of the stud;

positioning the module with its cold face generally adjacent the interior wall of the furnace;

capturing the fastener with a fastening tool made of a yieldable material for movement of the fastener conjointly with the fastening tool;

attaching the first end of the stud to the interior wall by arc welding through the fastening tool in engagement with the fastener;

compressing the mats against the interior wall of the furnace with a predetermined compression force by moving the fastener with the fastening tool toward the first end of the stud against the tine such that the tine is driven toward the first end of the stud, the tine pushing the module against the interior wall of the furnace as the fastener is moved thereby enveloping the protruding part of said first end of the stud within the module and compressing the mats of the module against the interior wall with the mats supplying an increasing reaction force resisting further movement of the tine and fastener toward the first end of the stud, the tine being driven toward said first end of the stud by the fastening tool until the reaction force is sufficiently large to cause the fastening tool material to yield and the fastening tool to release the fastener.

* * * * *